US005311730A

United States Patent [19]

Stahlecker et al.

[11] Patent Number: 5,311,730

[45] Date of Patent: * May 17, 1994

[54] SPINNING MACHINE WITH DRIVABLE TRANSPORT BELTS AND STATIONARY GUIDING BELTS FOR SLIVERS

[76] Inventors: Fritz Stahlecker, Josef-Neidhart-Strasse 18, 7347 Bad Überkingen; Hans Stahlecker, Haldenstrasse 20, 7334 Süssen, both of Fed. Rep. of Germany

[ * ] Notice: The portion of the term of this patent subsequent to Jun. 22, 2010 has been disclaimed.

[21] Appl. No.: 871,355

[22] Filed: Apr. 20, 1992

[30] Foreign Application Priority Data

Jul. 18, 1991 [DE] Fed. Rep. of Germany ..... 4123823

[51] Int. Cl.[5] ..... D01H 13/04

[52] U.S. Cl. ..... 57/90; 57/315

[58] Field of Search ..... 57/90, 315, 75

[56] References Cited

U.S. PATENT DOCUMENTS

| | | | |
|---|---|---|---|
| 2,896,269 | 7/1959 | Gardella et al. | 57/315 X |
| 3,312,050 | 4/1967 | Noguera | 57/90 |
| 3,816,991 | 6/1974 | Takeuchi et al. | 57/90 |
| 3,844,098 | 10/1974 | Plate et al. | 57/315 X |

FOREIGN PATENT DOCUMENTS 1015780 1/1966 United Kingdom .

*Primary Examiner*—Joseph J. Hail, III

*Attorney, Agent, or Firm*—Evenson, McKeown, Edwards & Lenahan

[57] ABSTRACT

In the case of a spinning machine having several spinning stations for the spinning of slivers fed in cans, drivable transport belts are provided for the transporting of the slivers from the cans to the spinning stations, to which stationary guiding belts are assigned which form a sliding guide for the slivers transported by the transport belts.

24 Claims, 14 Drawing Sheets

22
21
19
23
24
II
20
17
16
9
13
9'
12
B
B'
A
4
4'
A'
15
10'
8
10
8'
5
5'
C
C'
6
14
25
26
2
2'
18
3
3'
D
1
D
11
7

20D
30D
19D
29D
28D
31D
9D
9D'
13D
12D
B
B'
4D
4D'
A
A'
15D
10D
10D'
8D
8D'
5D
5D'
C
C'
37D
37D'
6D
14D
38D
2D
2D'
3D
3D'
40D
39D
D
D'
1D
11D
7D 19F
47F
9F
13F
9F'
12F
B
B'
4F
A
15F
A'
4F'
8F
10F
10F'
8F'
5F
5F'
C
48F
C'
46F
6F
2F
14F
27F
2F'
3F
3F'
32F
D
D
1F
11F
7F

51G 53G
9G
9G'
12G
13G
52
B
B'
A
A'
4G
4G'
15G
8G
8G'
C
C'
5G
5G
10G
10G'
49G
6G
14G
2G
2G'
3G
3G
32G'
53G
D
D'
1G
11G
7G

Fig.10
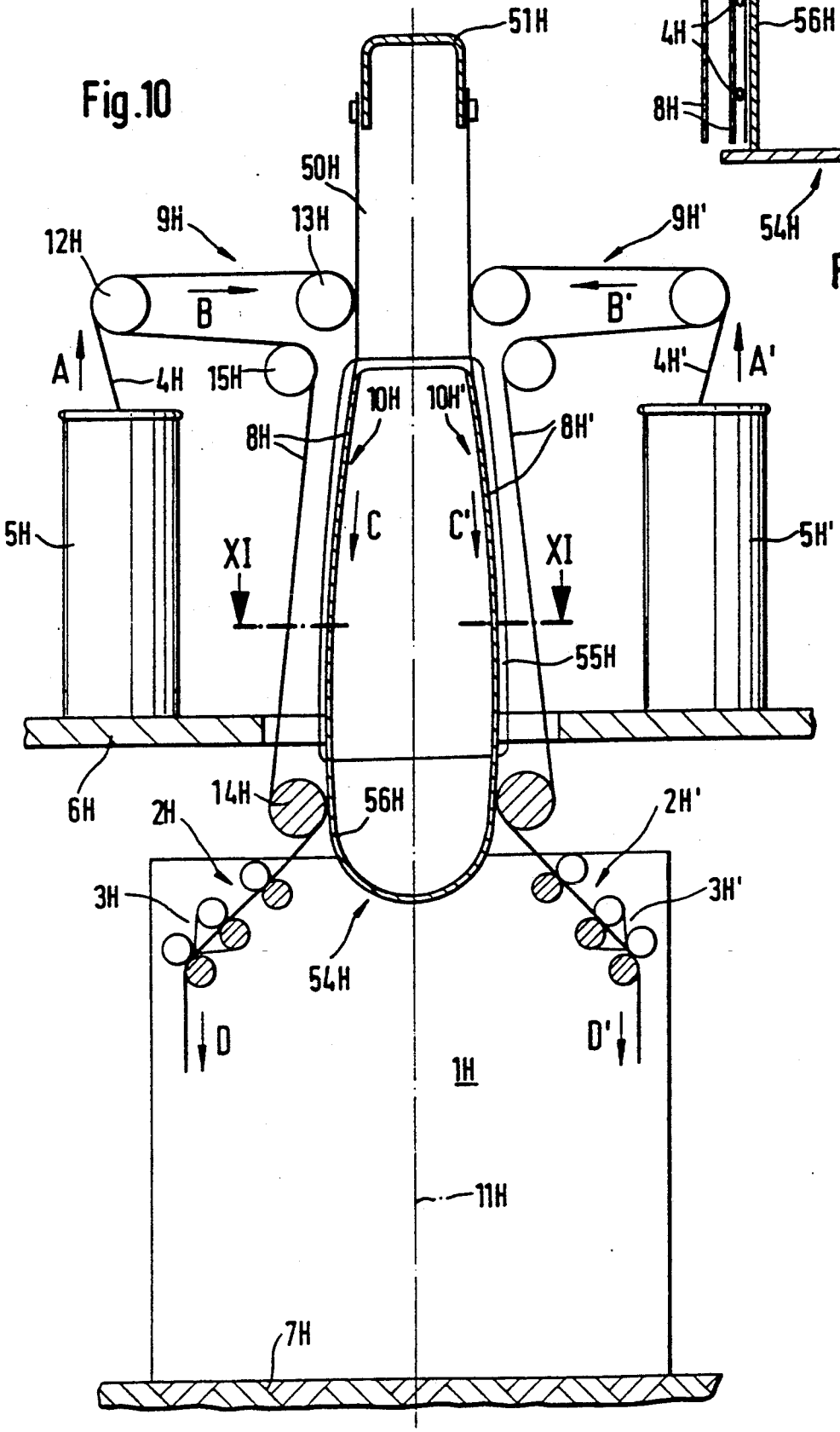
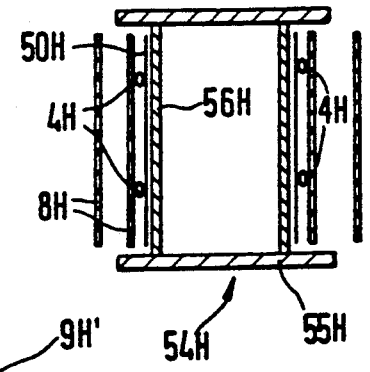
Fig.11

Fig.12
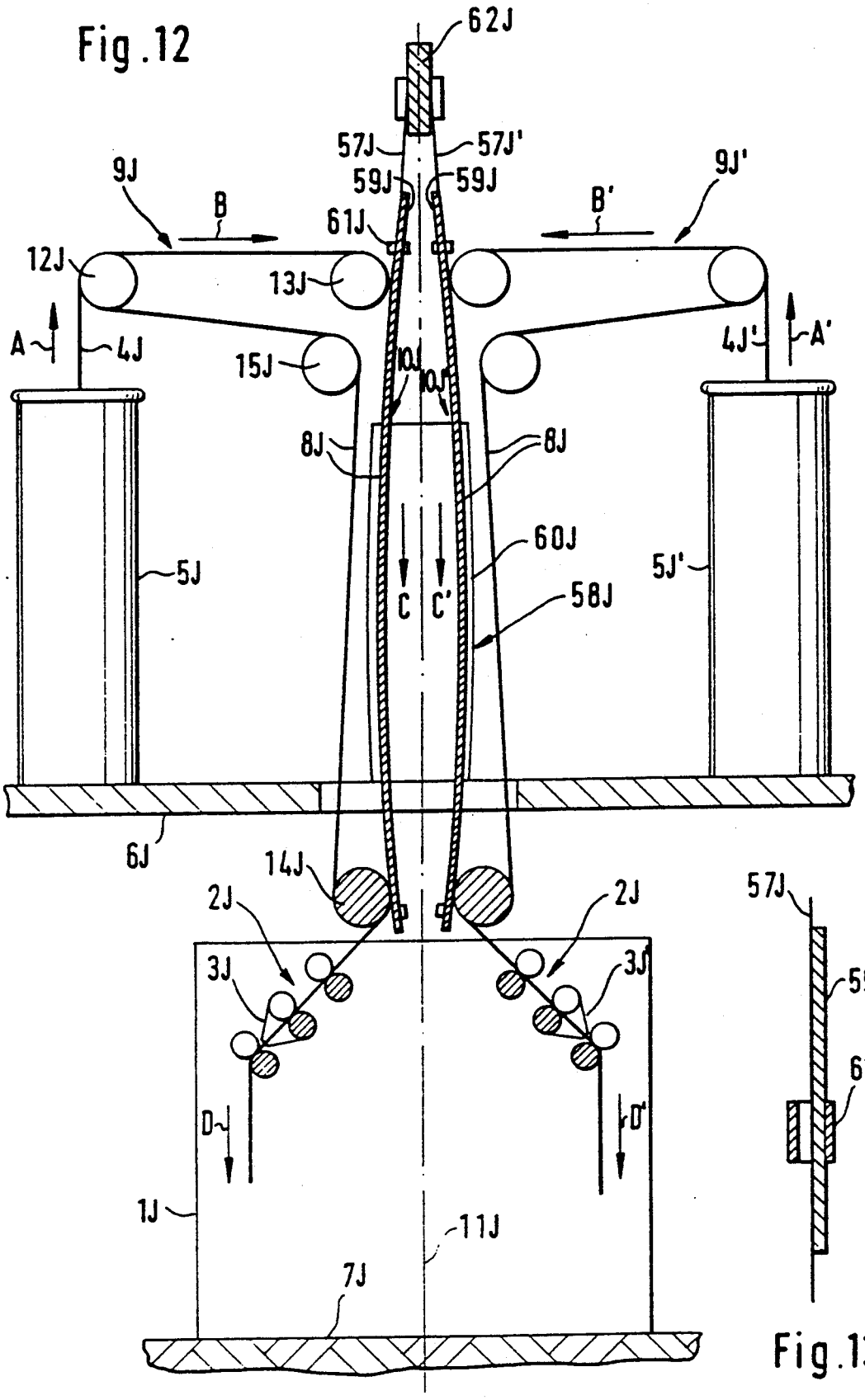
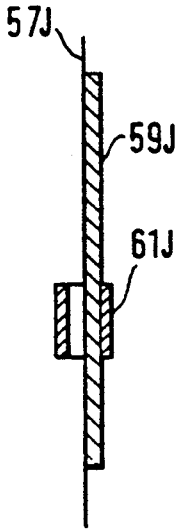
Fig.13

71L
19L
70L
69L
68L
9L
9L
16L
13L
12L
B
B'
10L
10L'
65L
65L'
4L
A
A'
4L'
15L
8L
8L'
5L
5L'
C
C'
66L
66L'
6L
14L
2L
2L'
3L
3L'
67L
1L
D
D'
7L
11L

SPINNING MACHINE WITH DRIVABLE TRANSPORT BELTS AND STATIONARY GUIDING BELTS FOR SLIVERS

Background and Summary of the Invention

This invention relates to a spinning machine comprising a plurality of spinning stations for the spinning of slivers fed in cans and comprising drivable transport belts for conveying the slivers from the cans to the spinning stations.

In the case of a known spinning machine of this type (British Patent Document GB 10 15 780), transport belts are provided for each sliver to be transported which run in parallel to one another and clampingly receive the sliver between one another and transport same. The drive of both transport belts is derived from the feeding roller pair of a drafting unit of the pertaining spinning station.

It is an object of the invention to provide a spinning machine of the initially mentioned type in which the expenditure for transport devices for the transport of the slivers from the cans to the spinning stations is reduced and the transport is improved at the same time.

This object is achieved according to preferred embodiments of the invention in that stationary guiding belts are assigned to the transport belts, are aligned in parallel to them and form a sliding guide for the slivers transported by the transport belts.

Because of this development, the expenditures for the transport device are reduced because, in each case, there is only one drivable transport belt. A large number of rotating or drivable elements are therefore not necessary. In addition, the stationary guiding belts have the advantage that, during the transport, they smooth out the slivers transported by the transport belts so that these slivers are fed to the spinning stations without the occurrence of a draft in a parallelized and stretched form. In this manner, it is possible to securely take very fine slivers of a size of approximately Nm 0.3 to approximately Nm 0.8 securely from the cans and feed them to the spinning stations without any danger of faulty drafts. These fine slivers, which have no or only a very slight twist, can be processed very well and particularly can be drawn to the desired fine yarn size in normal drafting units.

In a development of the invention, it is provided that the guiding belts are held under tensile stress and at least in their end areas are aligned on supporting devices. Thus, it is ensured that the stationary guiding belts have a smooth course and form a uniform guide for the slivers.

In a further development of the invention, devices are provided for deflecting the guiding belts toward the transport belts. As a result, it can be ensured that a uniform contact pressure exists along the whole path on which the slivers slide on the guiding belts. The same can be achieved in the case of another development of the invention in which devices are provided for the deflecting of the transport belts toward the guiding belts. In order to be able to carry out an adaptation to different slivers, that is, slivers of different sizes and/or made of different fiber materials, the devices for the deflecting are provided with devices for adjusting the extent of the deflection.

In a further development of the invention, it is provided in the case of a spinning machine comprising spinning stations arranged on both sides of the machine that common guiding belts and/or common devices for the deflecting and/or common tensioning devices for the guiding belts, which are arranged in the area of the longitudinal center plane of the machine, are assigned to the approximately vertical downward extending runs of the transport belts of opposite spinning stations. As a result, it is possible to use the necessary devices jointly for both sides of the machine so that the expenditures can be further reduced.

Other objects, advantages and novel features of the present invention will become apparent from the following detailed description of the invention when considered in conjunction with the accompanying drawings.

BRIEF DESCRIPTION OF THE DRAWINGS

FIG. 10 is a partial cross-sectional schematic view of a spinning machine with devices for the deflecting of tee guiding belts held by the stationary guiding belts, constructed according to another preferred embodiment of the invention;

FIG. 11 is a partial sectional view along Line XI—XI of FIG. 10;

FIG. 12 is a partial cross-sectional schematic view of a spinning machine with devices for deflecting the stationary slivers, constructed according to another preferred embodiment of the invention;

FIG. 13 is a partial sectional view of FIG. 12;

DETAILED DESCRIPTION OF THE DRAWINGS

In the following description of the different embodiments, similar reference numbers are used in all embodiments for structural members which correspond to one another, with letter suffices A, B, C, etc., for different embodiments. Unless specifically described in conjunction with embodiments other than FIG. 1, reference should be made to the FIG. 1 description for a description of correspondingly numbered features.

Figure 1:
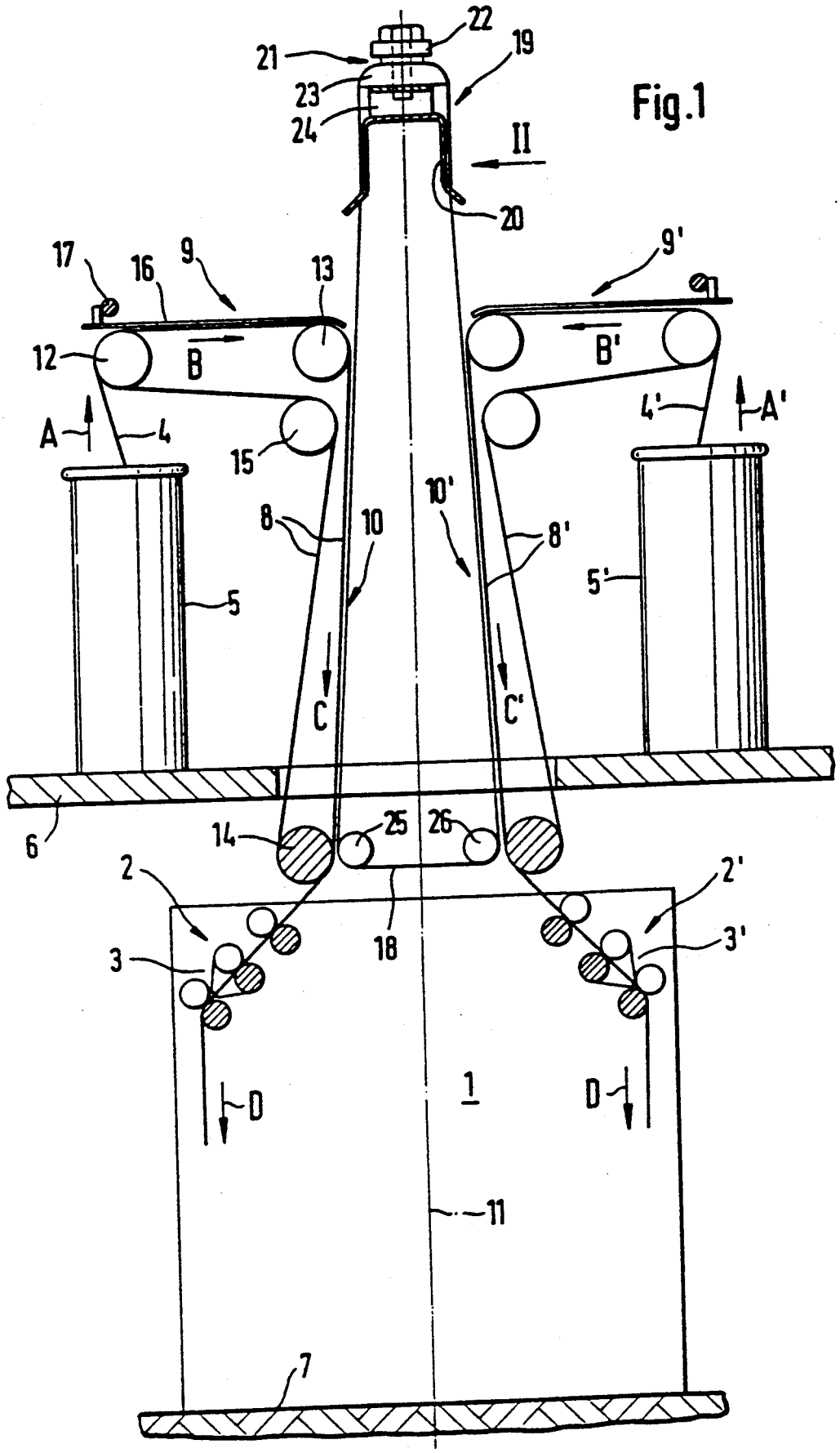
FIG. 1 is a partial cross-sectional schematic view of a two-sided spinning machine which is provided in the area of the longitudinal center plane of the machine with a guiding belt common to both sides of the machine which is guided in the area of the longitudinal center plane of the machine and is tensioned elastically, constructed according to a preferred embodiment of the invention.

In FIG. 1 and in the other embodiments, a spinning machine 1 is shown only very schematically. On both sides, the spinning machine 1 is provided with spinning stations 2, 2' which are each arranged in a row behind one another and of which only the respective drafting units 3, 3' are shown. The drafting units 3, 3' are constructed as customary three-cylinder drafting units. One sliver 4, 4' respectively that is to be drafted is fed to the drafting units 3, 3'. This sliver 4, 4' is taken out of cans 5 in the direction of the arrows (A, A') which are deposited on a platform 6 arranged above the spinning machine 1. Naturally, the cans 5, 5' may also be deposited at the level of the floor 7 for which principally the same measures are to be taken.

Very fine slivers 4, 4' are spun, that is, slivers of a size of approximately Nm 0.3 to approximately Nm 0.8 which, in addition, have no twist or no significant twist; that is, no more than a twist that is much smaller than the twist of the roving produced on a flyer. The slivers 4, 4', which have no significant twist, can therefore be very highly drafted in the drafting units 3, 3' to the desired yarn size. In order to transport the fine slivers 4, 4' securely from the cans 5, 5' to the spinning stations 2, 2' without any uncontrollable drafting of the slivers during the transport, they are transported by means of transport devices which each contain transport belts. These transport belts 8, 8' have a run 9 ,9' that starts above the cans 5, 5' and is essentially horizontal and a run 10, 10' that then leads downward in the area of the longitudinal center plane 11 of the machine. A principally similar arrangement would be achieved if the cans 5, 5' were deposited on the floor 7, in which case a first run of the transport belts 8, 8' then leads diagonally upward and a second run leads diagonally downward to the drafting units 3, 3' in such a manner that one operating aisle respectively is left in front of the spinning stations 2, 2'. Since, as a rule, the cans 5, 5' have a diameter which is larger than the distance between two spinning stations 2, 2' arranged in a row, these cans 5, 5' are arranged, in a manner not shown in detail, in several rows extending in the longitudinal direction of the machine. The horizontal runs 9 (or also the diagonal runs when the cans are deposited on the floor), in each case, extend approximately beyond the center of the cans 5, 5' so that transport belts 8, 8' of different lengths are provided for the individual rows of cans 5, 5'.

The transport belts 8, 8' are guided by means of deflecting rollers 12, 13, 14, 15 in such a manner that also the returning run takes an essentially angular course; that is, a course that is approximately parallel to the runs 9 and 10. The deflecting roller 15 which guides the returning run of the transport belts 8, 8' is constructed as a tension roller. The lower deflecting roller 14, which is arranged in the feeding area of the drafting units 3, 3', is constructed as a driving roller. It is a component of a drivable shaft 14 extending through in the longitudinal direction of the machine. The driving speed of the shaft 14 is slightly less than the feeding speed of the feeding roller pair of the drafting units 3, 3' so that a tensioning of the slivers 4, 4' takes place during the feeding, but the slivers 4, 4' do not receive any draft here in this area. The transport belts 8, 8' have a width which is sufficient for transporting two slivers 4, 4' simultaneously; that is, the slivers 4, 4' which are fed to two adjacent drafting units 3, 3' of one side of the machine; that is, to the drafting units which, as customary, have common pressure roller pairs which are carried by a joint load carrier.

In order to protect and securely guide the slivers 4, 4' during the transport on the transport belts 8, 8', sliding guides are assigned to these transport belts 8, 8' which press the slivers 4, 4' with a slight, preferably predeterminable uniform contact pressure against the transport belts 8, 8'. In the embodiment according to FIG. 1, skids 16 which rest on the slivers 4, 4' are provided for this purpose in the horizontal runs 9, 9'. The skids 16 which only loosely rest on the slivers 4, 4' with their own weight are secured against being taken along in the transport direction by means of a stop 17 which is constructed as a rod extending through in the longitudinal direction of the machine. In the area of the vertical runs 10, 10', this sliding guide is formed by a stationary guiding belt 18 which is arranged and designed such that it forms the sliding guides for the transport belts 8, 8' of two spinning stations 2, 2' situated opposite one another on both sides of the machine. On the side facing the transport belts 8, 8', the guiding belt 18 as well as the skid 16 have smooth surfaces which only offer slight frictional resistance to the slivers. As the guiding belt 18, steel bands of a thickness of from 0.3 mm to 0.5 mm are used which are made of rustproof steel—which applies also to the guiding belts of the other embodiments. Other materials may also be used for the stationary guiding belts 18, such as textile belts or plastic belts which must mainly meet the requirement with respect to the slight frictional resistance to the slivers 4, 4'. The stationary guiding belts 18 must be aligned and supported and held in such a manner that their sliding surfaces are positioned such with respect to the transport belts 8, 8' that a uniform guiding force exists on the whole path between deflecting roller 13 and deflecting roller 14. It is important in this case that these stationary guiding belts 18 are held and supported in such a manner that they cannot undulate or twist or otherwise deform.

Figure 2:
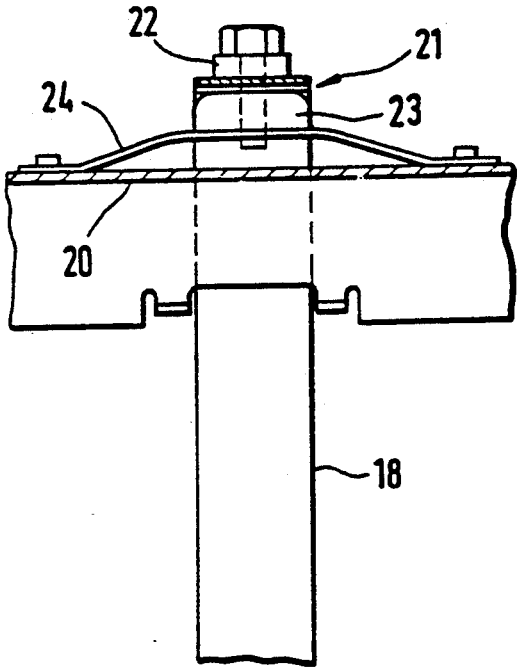
FIG. 2 is a partially sectional partial view in the direction of the arrow II of FIG. 1.

In the case of the embodiment according to FIG. 1 and 2, the stationary guiding belts 18 are fastened in the area of a longitudinal rail 20 arranged above the spinning machine 1 and above the platform 6 and are tensioned by means of a tensioning device 19. In the area of the lower deflecting rollers 14, the guiding belts 18 are placed around supporting elements 25, 26 which are constructed as cylindrical rods. These supporting elements 25, 26 can preferably be adjusted in their distance to the deflecting rollers 14. The ends 21 of the guiding belts 18 are placed above one another in the area of the guide rails 20 and are provided with recesses which are penetrated by a screw. By means of this screw, the ends 21 are held between a pressure plate 22 and a tensioning nut 23. Between the tensioning nut 23 and the guide rail 20, a bent leaf spring 24 is arranged which supports itself with its ends on the cross web of the U-shaped guide rail 20. The ends of the leaf spring 24 are provided with sliding elements. The guiding belts 18 place themselves planely against the side legs of the guide rail 20. They are laterally secured by means of brackets bent at right angles out of the side legs. The tensioning forces of the tensioning device 19 applied by the leaf spring 24 are so large that the guiding belts 18 are stretched tight so that they have a straight course, being aligned exactly in parallel to the transport belts 8, 8' so that a uniform distribution of the contact pressure forces occurs by means of which they rest against the slivers 4, 4'.

Figure 3:
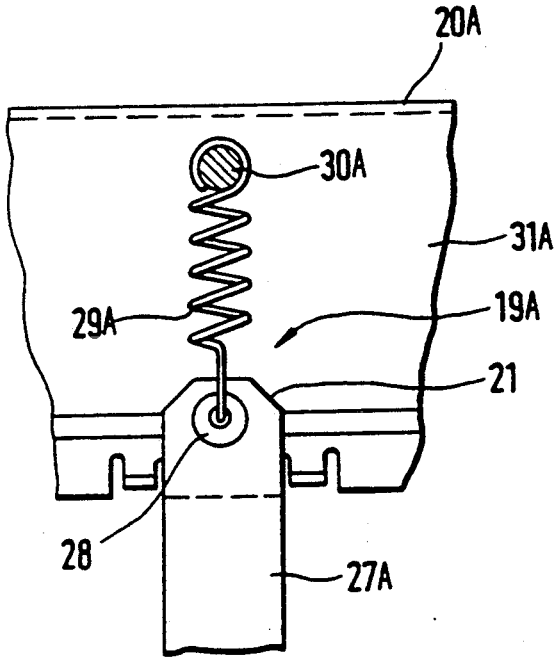
FIG. 3 is a partial view corresponding to FIG. 2 of another development of the holding device and tensioning device of a common guiding belt for opposite spinning stations of a spinning machine, constructed according to another preferred embodiment of the invention.

FIG. 3 illustrates a tensioning device 19A which in its function corresponds to the tensioning device 19 according to FIGS. 1 and 2. In the case of this tensioning device 19A, the ends 21A of the guiding belts 27A are hung into coil springs 29A, the other ends of which are pivotally connected to transverse pins 30A which are mounted on the guide rail 20A (also compare FIG. 6). The side legs 31A of the guide rail 20A are bent at right angles toward the outside in such a manner that the end areas of the guiding belts 27A rest planely against the ends of the side legs 31A bent away at right angles and are also guided beyond that by means of lateral guide brackets. This ensures that a plane contact also exists in this area between the guiding belts 27A and the guide rail 20A so that the guiding belts 27A are stretched out smoothly. As illustrated in FIG. 3, the ends 21A of the guiding belts 27A are provided with a reinforcement 28A constructed in the manner of a tubular rivet into which the respective coil spring 29A is hung.

Figure 4:
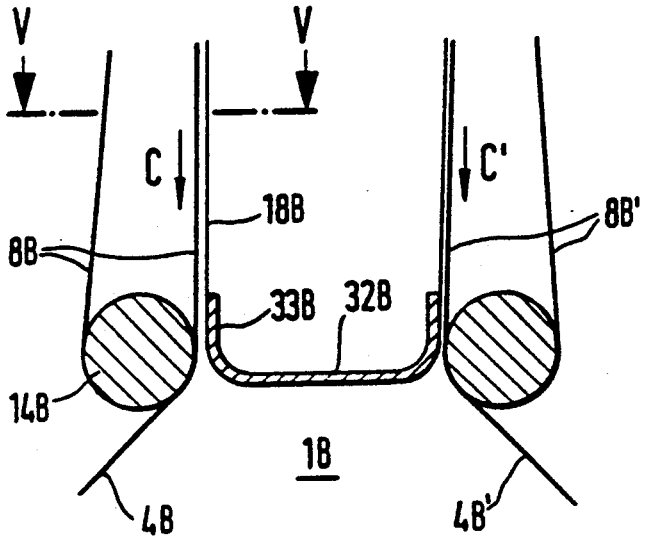
FIG. 4 is a partial view of an embodiment similar to FIG. 1 with a changed lower support of the guiding belts.

In the embodiment according to FIG. 4, it is provided that the two supporting elements 25, 26 are replaced by a U-shaped guide rail 32B, the side legs 33B of which extend in parallel to the axes of the deflecting rollers 14B so that the guiding belts 18B are aligned also in this area precisely in parallel to the transport belts 8B, 8B'.

Figure 5:
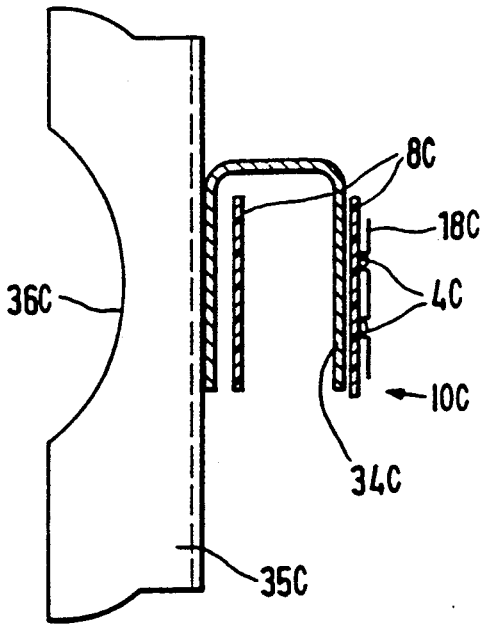
FIG. 5 is a partial sectional view along Line V—V of FIG. 4 with an additional guiding device.

As illustrated in FIG. 5, the embodiment according to FIG. 1 can be supplemented by the fact that the fiber-carrying run of the transport belt 8C is supported by means of a supporting device 34C in the area of the approximately vertical run 1OC. In the case of the shown embodiment, this supporting device 34C consists of a sheet metal profile which is bent in a U-shape and at the one leg of which the fiber-carrying run slides of the transport belt 8C. The returning run is guided back inside the two legs. The supporting device 34C is fastened to a profile rail 35C which extends in the longitudinal direction of the machine and is constructed as a so-called can metal sheet, that is, is provided with saucer-type cutouts 36C on which the cans 5, 5' of the respective innermost row of cans are aligned. As also illustrated in FIG. 5, the transport belt 8C, in each case, transports two slivers 4 which are fed to two adjacent spinning stations. The guiding belt 18C is designed to be slightly narrower than the transport belt 8C so that it is prevented that fibers are hung up on the edge of the guiding belt 18C. These are any case stripped off by the transport belt 8C.

Figure 6:
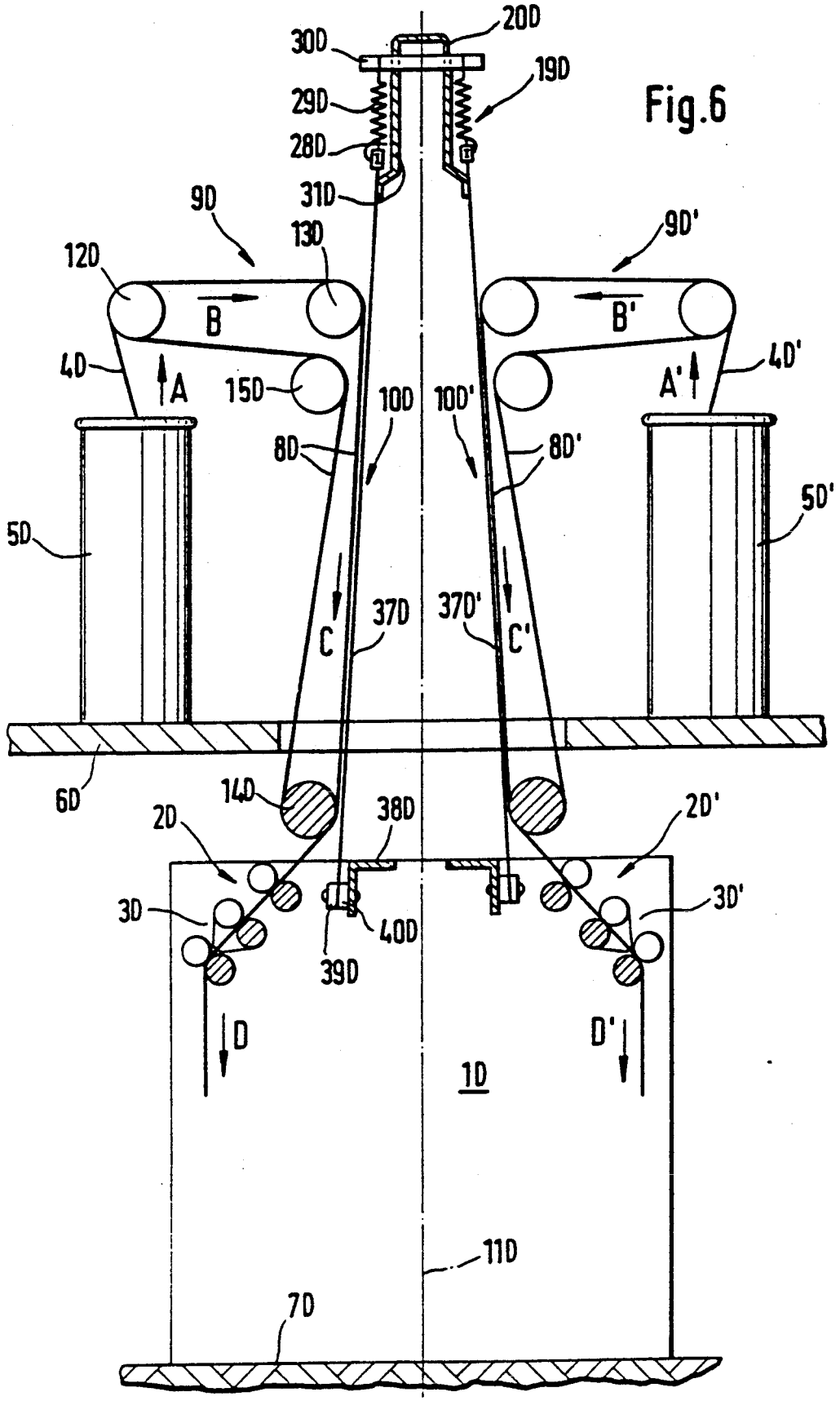
FIG. 6 is a partial cross-sectional view of a spinning machine similar to FIG. 1, however, with stationary guiding belts which are held and tensioned independently for both sides, constructed according to another preferred embodiment of the invention.

In the case of the embodiment according to FIG. 6, separate stationary guiding belts 37D, 37D' are provided. The lower ends of the guiding belts 37D, 37D' are fastened to profile rails 38D of the spinning machine 1D which extend in the longitudinal direction of the machine. Between the profile rails 38D and the fastening devices 39D for the guiding belts 37D, spacer blocks 40D are arranged, the distance between the guiding belts 37D, 37D' and the transport belts 8D, 8D' being adjustable by means of spacer blocks of different sizes. The upper ends of the guiding belts 37D, 37D' are fastened by means of a tensioning device 19D corresponding to FIG. 3 on a guide rail 20D extending through in the longitudinal direction of the machine. Also in this embodiment, the guiding belts 37D, 37D' are prestressed in such a manner that they take up an exactly defined position; that is, that they can neither twist, nor undulate, nor otherwise deform.

Figure 7:
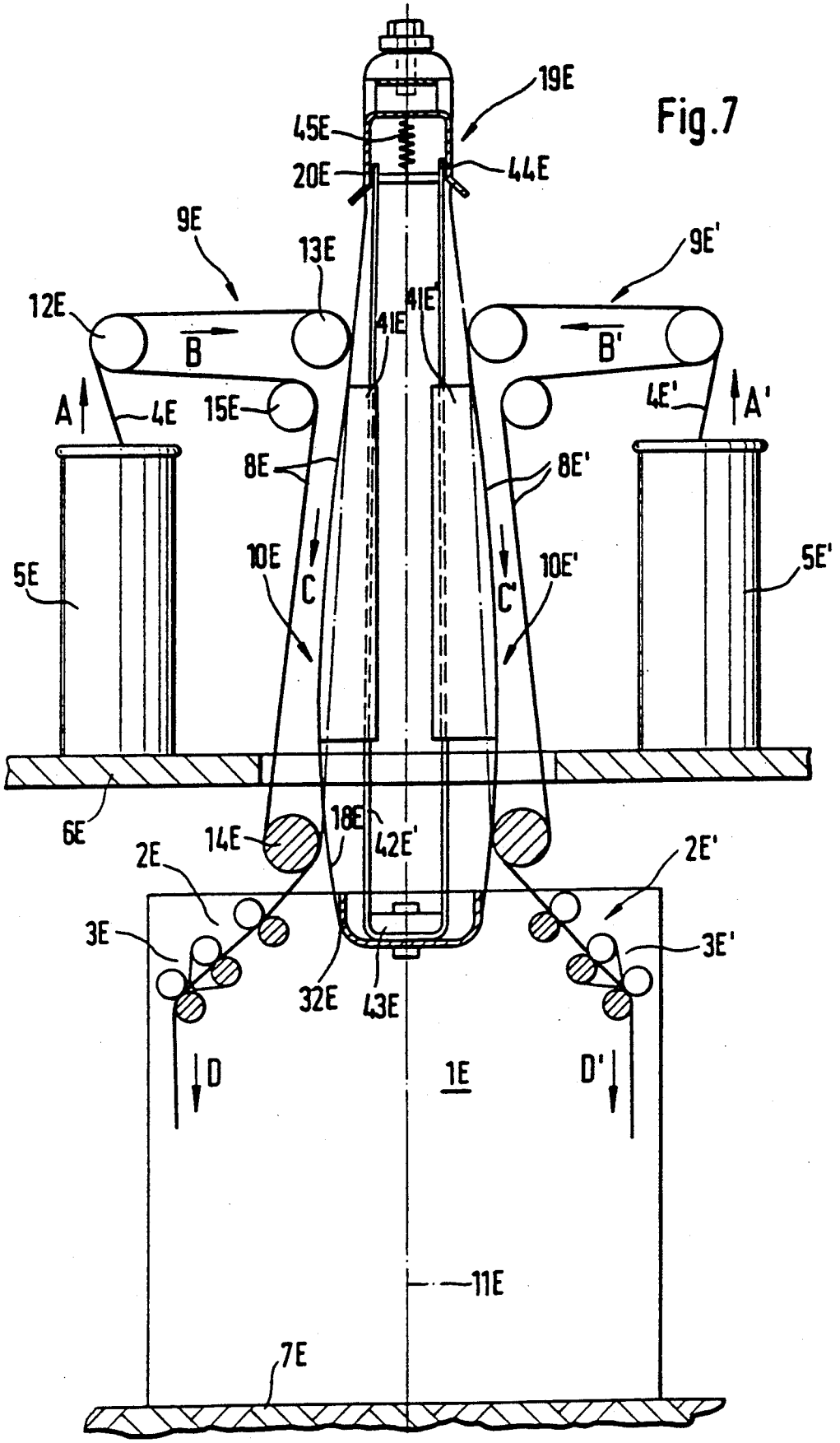
FIG. 7 is a partial cross-sectional schematic view of a spinning machine with additional supporting devices which deflect the stationary guiding belts in the direction of the transport belts, constructed according to another preferred embodiment of the invention.

In its basic construction, the embodiment according to FIG. 7 corresponds to the embodiment according to FIG. 1. A joint stationary guiding belt 18E is provided for two adjacent spinning stations 2E, 2E' respectively of the opposite machine sides, which is held in the area of the drafting units 3E, 3E' by means of a supporting rail 32E. The upper ends are fastened by means of a tensioning device 19E corresponding to FIGS. 1 and 2 on a guide rail 20E extending through in the longitudinal direction of the machine. In the area of the approximately vertical runs 10E, 10E', deflecting elements 41E, 41E' are provided which deflect the guiding belt 18E in each case toward the transport belts 8, 8' in a fishbellied manner. These deflecting elements 41E, 41E' consist of profiles which are edged in a U-shape and which by means of their legs support the sides of the guiding belts 18E which are opposite the transport belts 8E, 8E'. As illustrated in FIG. 7, the outer ends of the deflecting elements 41E, 41E' are convexly curved with a flat curvature so that a fishbellied guiding is achieved.

The deflecting elements 41E, 41E' are riveted to a relatively strong sheet metal band 42E which has several times the strength of the guiding belts 18E. Since the sheet metal band 42E does not come in contact with the fiber material, it may consist of a conventional sheet steel. In the area of the supporting rail 32E, the sheet metal band 42E is held by means of a pressure piece 43E. The upper ends 44E are connected with one another by means of a cross yoke and are fastened by means of a tension spring 45E on the guide rail 20E extending through in the longitudinal direction of the machine.

Figure 8:
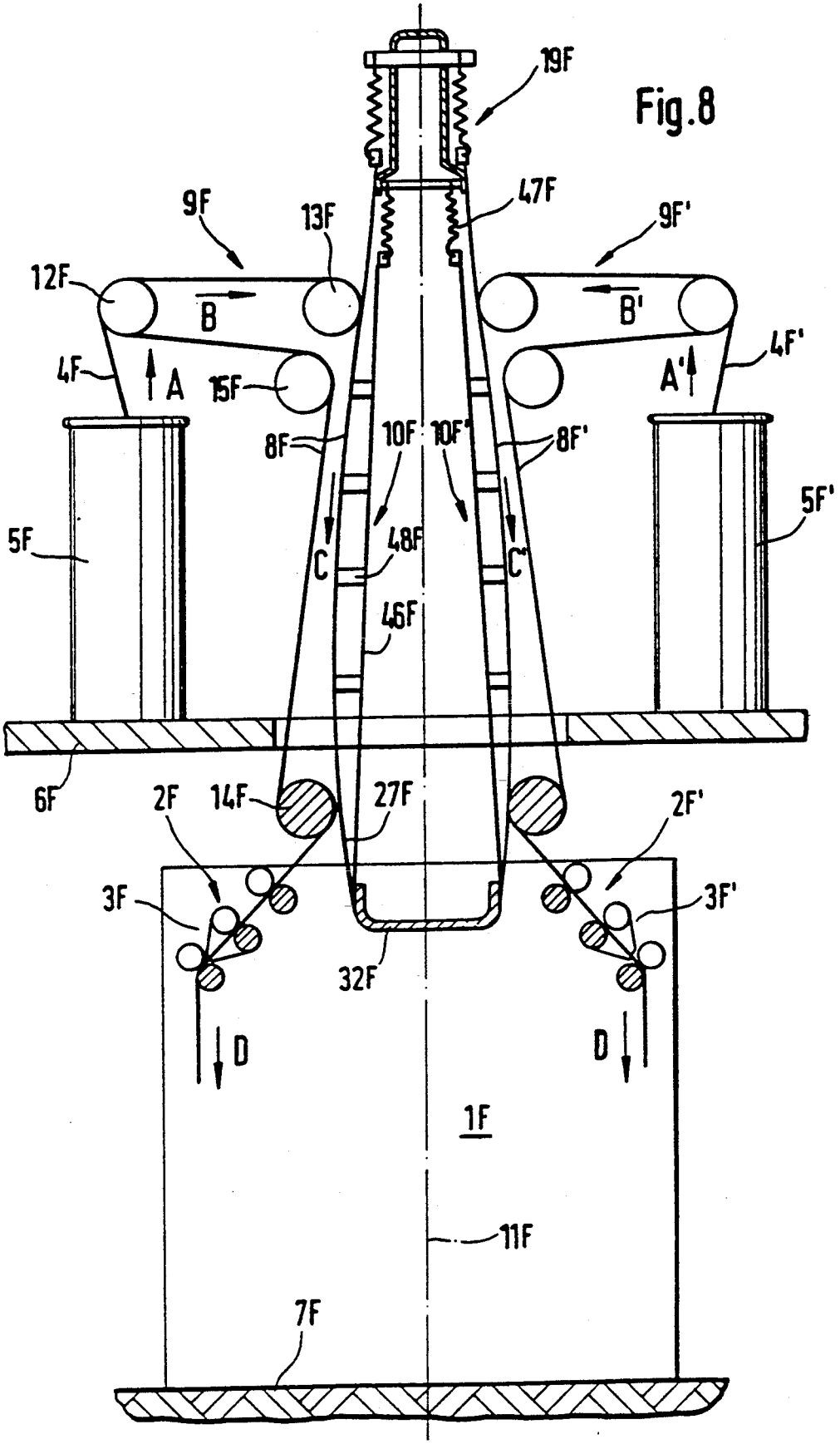
FIG. 8 is a partial cross-sectional schematic view of a spinning machine with additional supporting devices which deflect the stationary guiding belts and are held by means of spring tension, constructed according to another preferred embodiment of the invention.

A holding device for the stationary guiding belts which in principle corresponds to the embodiment according to FIG. 7 is provided in the case of the spinning machine according to FIG. 8 for the guiding belts 27F. In this embodiment, the relatively thick sheet metal band 46F is placed around the supporting rail 32F in the area of the spinning machine IF. In a spaced manner, supporting elements 48F are mounted on this sheet metal band 46F which are made, for example, of plastic and which cause the desired fishbellied deflection of the guiding belts 27F in the area of the approximately vertical runs 10F, 10F'. The ends of the sheet metal band 46F are pivotally connected to a traverse of the rail 20F by means of tension springs 47F.

With respect to FIGS. 7 and 8, it should be noted that the sheet metal bands 42E, 46F, even if they are significantly stronger than the guiding belts 18E, 27F, have a certain elasticity in the transverse direction to the runs 10E, 10F, 10', 10F'. They will therefore correspondingly easily deform from the stretched position as a function of the forces applied by the tensioning device 19E, 19F and the springs 45E or 46F. By means of the coordination of the spring forces of the tensioning device 19E, 19F and of the springs 45E and 47F, the extent of this deformation can be determined and thus the fishbellied deflection of the guiding belts 18E, 27F can be determined in the direction of the transport belts 8E, 8F, 8', 8F' In this case, it can be provided in a manner which is not shown that the tensioning forces of the tensioning device 19E, 19F and/or of the springs 45E, 47F is adjustable so that the extent of the deflection and thus also the contact force of the guiding belts 18E, 27F is adjustable in the direction of the transport belts 8E, 8F, 8', 8F'.

Figure 9:
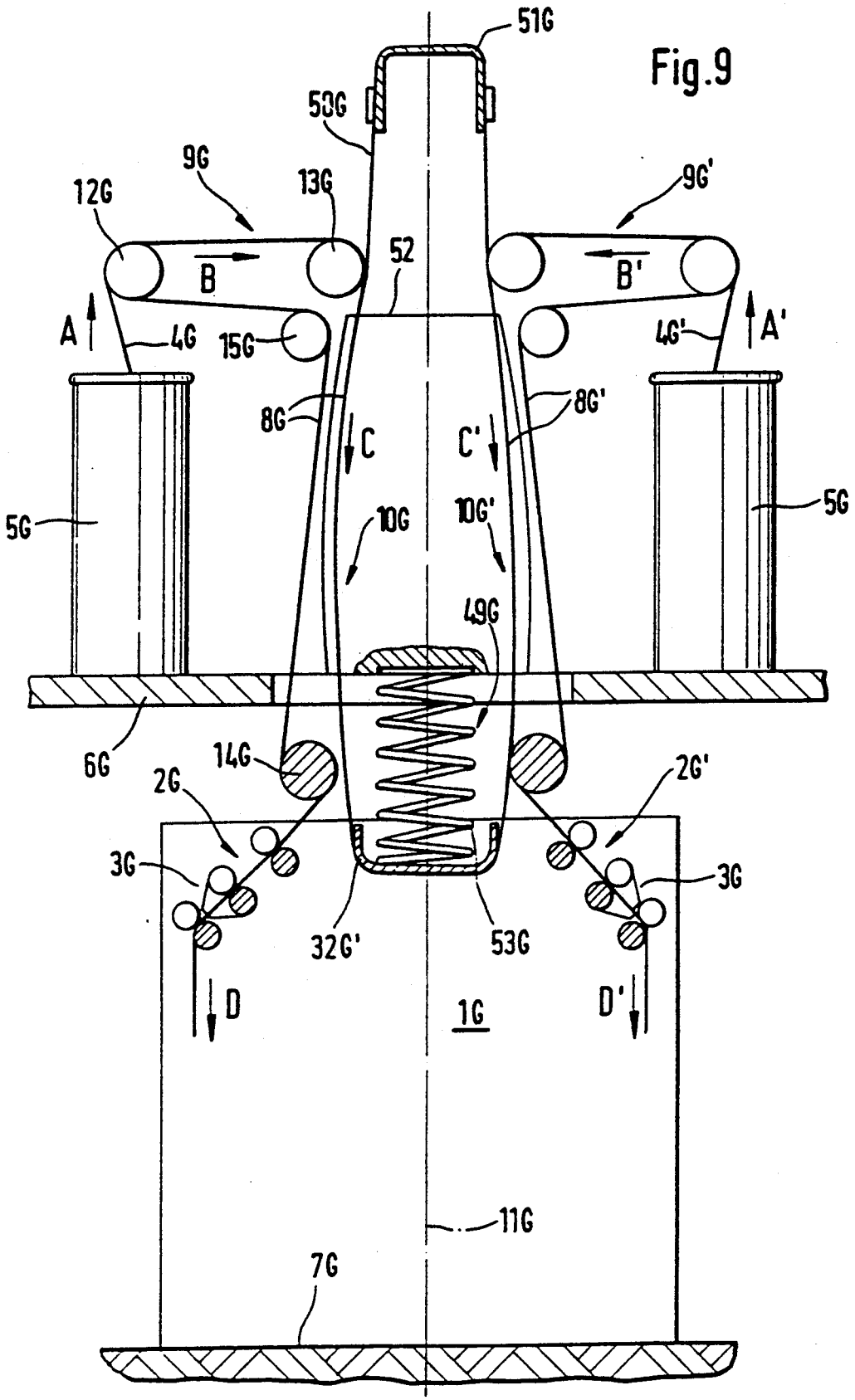
FIG. 9 is a partial cross-sectional schematic view, similar to FIG. 8, of a spinning machine having a tensioning device for the stationary guiding belts arranged in the area of the lower deflecting guide, constructed according to another preferred embodiment of the invention.

In the embodiment according to FIG. 9, common stationary guiding belts 50G are also provided for the mutually opposite spinning stations 2G, 2G' of a two-sided spinning machine 1G. These guiding belts 50G are fastened on a guide rail 51G arranged above the spinning machine 1G and above the deflecting rollers 12G, 13G and extending in the longitudinal center plane 11G of the machine. In the area of its lower ends, a tensioning device 49G is provided which is formed of a movable guide support 32G', which is shaped in the manner of the guide rail according to FIG. 4, and of a pressure spring 53G which is supported against the platform 6G. In addition, in the area of the approximately vertical runs 10G, 10G', a deflecting element 52G is provided which deflects the guiding belts 50G in the direction of the transport belts 8G, 8G'. The construction of this deflection element 52G, which is designed as a box, corresponds to the construction of the deflecting element 54H which will be explained by means of FIGS. 10 and 11.

In the embodiment according to FIG. 10, corresponding to the embodiment of FIG. 9, one-piece stationary guiding belts 50H are provided for respective opposite spinning stations 2H, 2H' of a spinning machine and are hung onto a guide rail 51H arranged in the longitudinal center plane 11H of the machine above the spinning machine 1H. Corresponding deflecting elements 54H are suspended into each of these guiding belts 50H and tension the guiding belts 50H because of their own weight and at the same time deflect it in a fishbellied manner in the direction of the transport belts 8H, 8H'. As illustrated in FIG. 1, these deflecting elements 54H comprise a box which has two side shields 55, between which a metal guide sheet 56H is arranged which determines the course of the guiding belts 50H. As also shown in FIG. 11, the side shields 55H project over the metal guide sheet 56H so that they form a lateral guide for the guiding belts 50H and for the transport belts 8H, 8H'. In this case, the weight of the deflecting element 54H is used as a tensioning device.

In the embodiment according to FIGS. 12 and 13, two stationary guiding belts 57J, 57J' are hung onto a guiding profile 62J extending in the longitudinal center plane 11J of the machine. At the lower ends of the guiding belts 57J, 57J', which are each assigned to only one side of the machine and which are situated approximately at the level of the deflecting rollers 14J of the transport belts 8J, 8J', a box-shaped deflecting element 58J is fastened which, in turn, forms a fishbellied deflecting contour. The deflecting element has two side shields 60J which project laterally beyond the metal support sheets 59J, 59J' determining the contour of the guiding belts 57J, 57J'. The metal support sheets 59J, 59J' each project upward and downward clearly beyond the side shields 60J so that, in this area, they are elastically flexible within certain limits transversely with respect to the runs 10J, 10J'. As illustrated in FIG. 13, in the area of the upper ends of the metal support sheets 59J, 59J', guide lugs 61J are provided which hold the thin guiding belts 57J, 57J' on the metal support sheets 59J, 59J'. Also in the case of this embodiment, the weight of the deflecting body 58J is used as a tension force for the stationary guiding belts 57J, 57J'.

Figure 14:
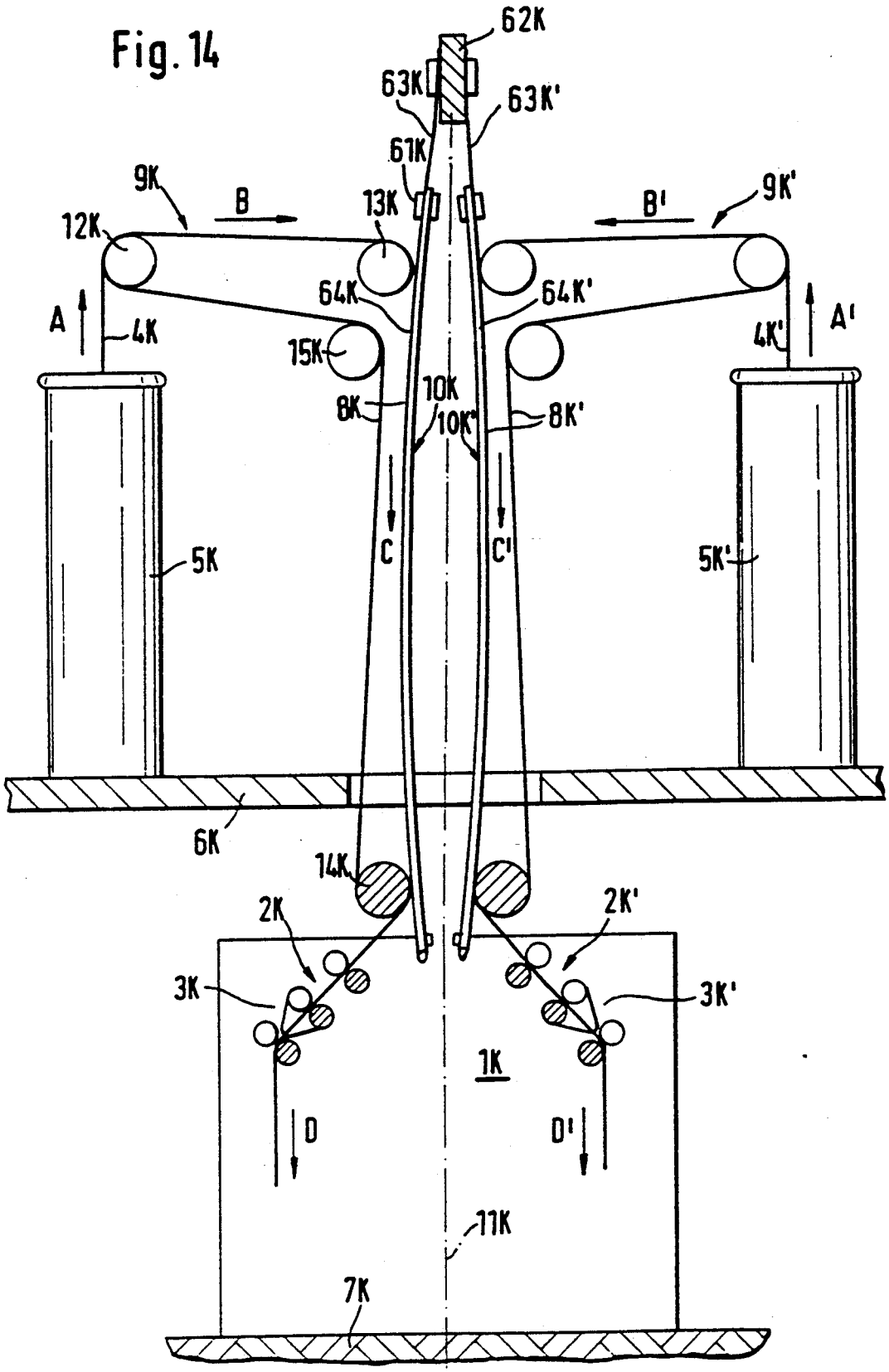
FIG. 14 is a partial cross-sectional schematic view, similar to FIG. 12, of a spinning machine constructed according to another preferred embodiment of the invention.

The embodiment according to FIG. 14 correspond essentially to the embodiment according to FIGS. 12 and 13. However, instead of a box-shaped deflecting element, only two metal support sheets 64K, 64K' are provided for the stationary guiding belts 63K, 63K' which are fixedly connected at their lower ends with these metal support sheets 64K, 64K'. In the area of the upper ends of the metal support sheets 64K, 64K', guide lugs 61K are situated which hold the guiding belts 63K, 63K' on the metal support sheets 64K, 64K'. The metal support sheets 64K, 64K' have a slightly convex curvature toward the transport belts 8K, 8K' so that here again the fishbellied guiding contour is implemented. It is possible to suspend the guiding belts 63K, 63K' in such a manner that, because of their own weight, they place themselves against the transport belts 8K, 8K'. As a modification of the shown embodiment, however, it may also be provided that an expanding spring or the like is arranged between the two metal support sheets 64K, 64K'.

Figure 15:
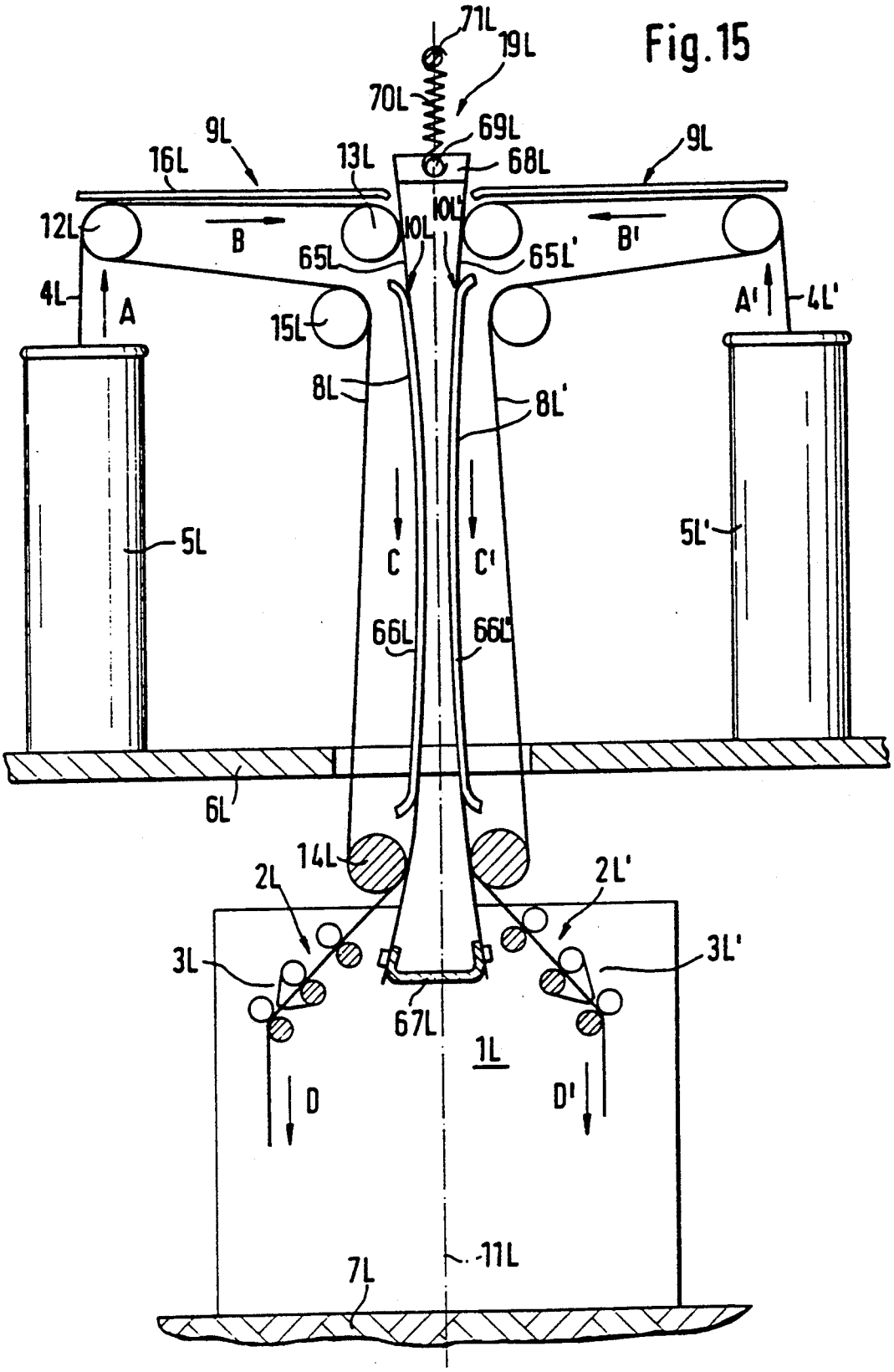
FIG. 15 is partial cross-sectional schematic view of a spinning machine with deflecting devices deflecting the transport belts in the direction of the stationary guiding belts, constructed according to another preferred embodiment of the invention.

In the embodiment according to FIG. 15, separate stationary guiding belts 65L, 65L' are assigned to the transport belts 8L, 8L' of the spinning stations 2L, 2L' of the opposite machine sides. These guiding belts 65L, 65L' are fastened to a rail 67L below the deflecting rollers 14L. Transversely to the longitudinal direction of the machine, the rail 67L has a width which is larger than the distance between the two opposite deflecting rollers 14L. The upper ends of the guiding belts 65L, 65L' are fastened to a common traverse 68L which, by way of a tensioning device 19L containing a spring 70L, is fastened to a holding profile 71L extending in the longitudinal direction of the machine in the longitudinal center plane 11L of the machine. In a manner not shown in detail, it may be provided in this case that the springs 70L, which are pivotally connected to pins 69L of the traverses 68L, can be prestressed to different tensile forces. The traverse 68L situated above the deflecting rollers 13L holds the guiding belts 65L, 65L' at a distance which is slightly larger than the distance of the opposite deflecting rollers 13L.

In the area of the approximately vertical runs 10L, 10L', the transport belts 8L, 8L' are provided with deflecting elements 66L, 66L' designed as back supports which deflect the runs of the transport belts 8L, 8L' carrying the slivers 4L, 4L' in the direction of the stationary guiding belts 65L, 65L' so that a fishbellied course occurs here also. By adjusting the traverse 68L, which may extend along several spinning stations, the contact pressure between the slivers 4L, 4L' and the guiding belts 65L, 65L' can be adjusted.

Figure 16:
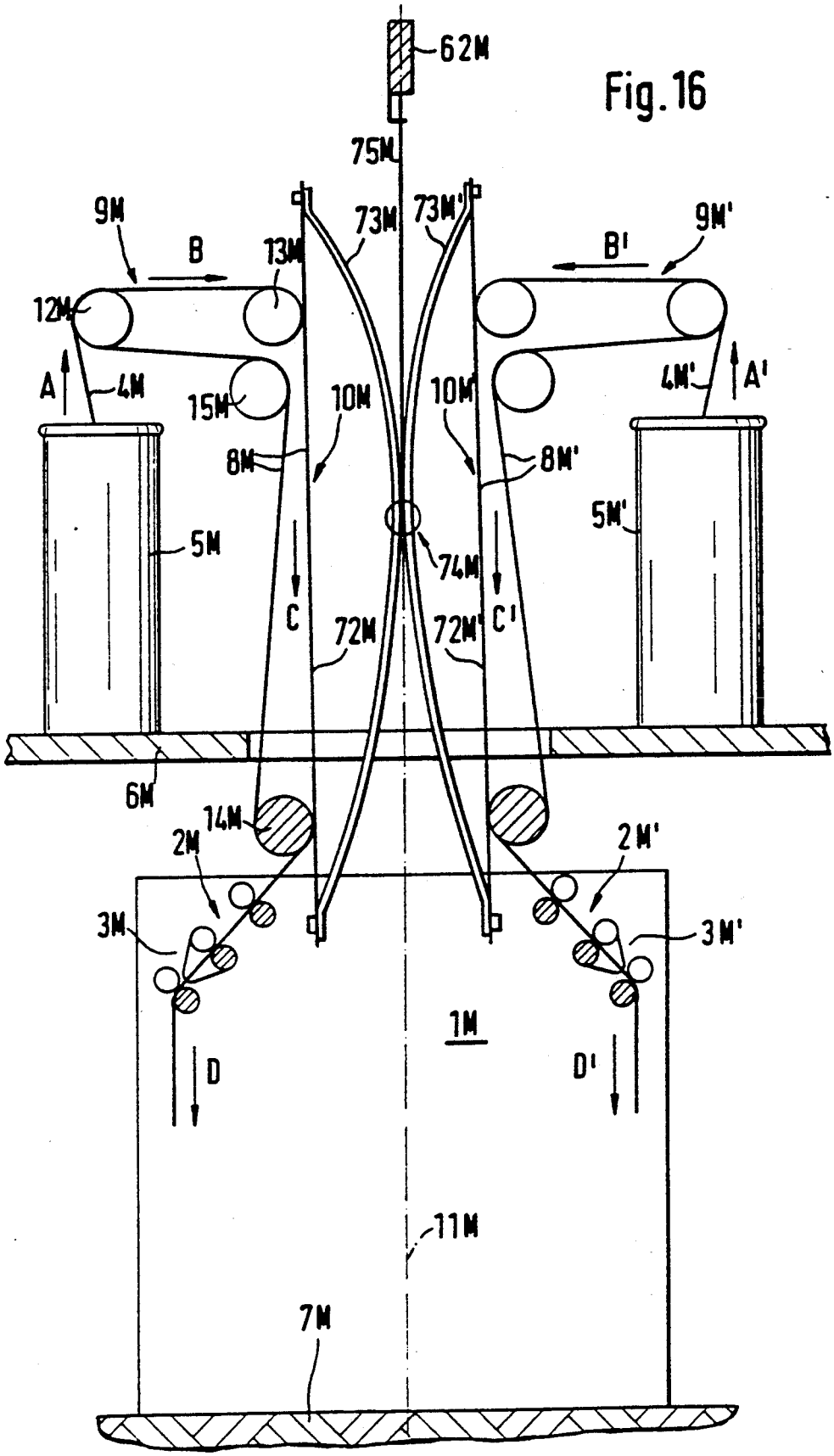
FIG. 16 is a partial cross-sectional schematic view of a spinning machine with stationary guiding devices tensioned as strings of a bow, constructed according to another preferred embodiment of the invention.

In the embodiment according to FIG. 16, separate stationary guiding belts 72M, 72M' are provided for the transport belts 8M, 8M' of the two opposite sides of the machine and extend along the, in this case, vertical runs 10M, 10M' and are held by means of a common holding device on a profile 62M extending in the longitudinal center plane 11M of the machine in the longitudinal direction of the machine. The two guiding belts 72M, 72M' are each fastened in the manner of a string to the ends of bows 73M, 73M' by which they are tightly stretched. In the area of their center, the two bows 73M, 73M' are connected with one another with a connecting element 74M to which a tension band 75M is pivotally connected by which the bows 73M, 73M' are suspended on the longitudinal profile 62M. The guiding belts 72M, 72M' extend along the vertical runs 10M, 10M', in each case projecting over deflecting rollers 13M in the upward direction and over deflecting rollers 14M in the downward direction.

Figure 17:
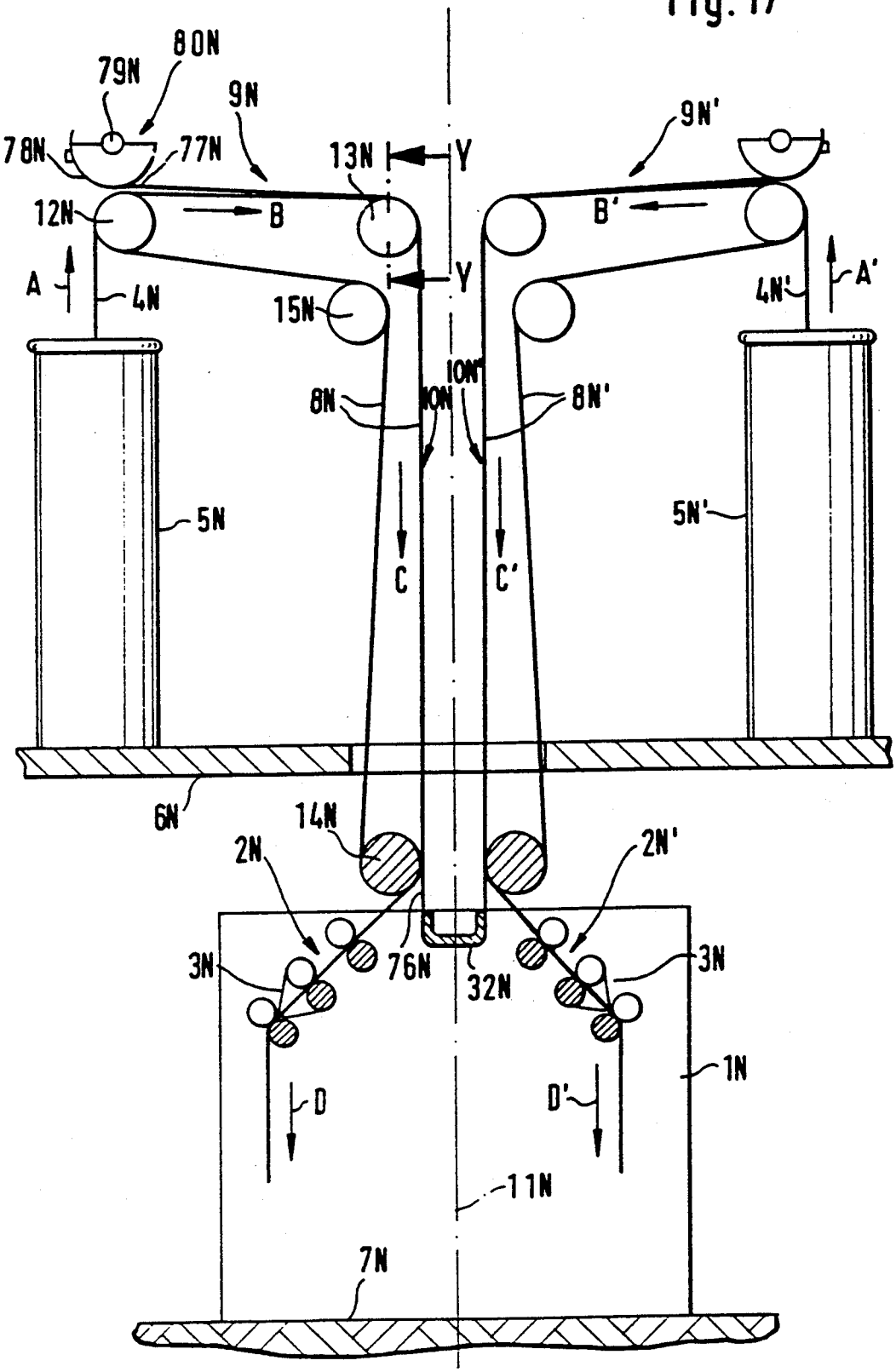
FIG. 17 is a partial cross-sectional schematic view of a spinning machine having stationary guiding belts which follow an essentially horizontal run and an essentially vertical run of the transport belts, constructed according to another preferred embodiment of the invention.

FIG. 17 illustrates an embodiment of a spinning machine according to the invention in which stationary guiding belts 76N are provided for the horizontal runs 9N as well as for the vertical runs 10N, 10N; of the transport belts 8N, 8N'. In this embodiment, one common guiding belt 76N respectively is provided for the mutually opposite spinning stations 2N, 2N' of both machine sides, this common guiding belt 76N being placed around a supporting profile 32N in the area of the longitudinal center plane 11N of the machine below the deflecting rollers 14N. The two ends of the guiding belts 76N are fastened to tension devices 80N which are arranged above the deflecting rollers 12N; that is, the deflecting rollers 12N of the transport belts 8N, 8N' situated above the cans 5N, 5N'. The ends 77N of the guiding belts 76N are fixed to a rotary segment 78N which can be clamped around a shaft 79N against a torsion spring which is not shown. In order to avoid that the guiding belts 76N are pressed too intensely against the transport belts 8N, 8N' or the slivers 4N, 4N' in the area of the deflecting rollers 13N, additional supporting devices are provided in this area which hold the stationary guiding belts 76N in this area at a distance from the corresponding transport belt 8N, 8N'. In the case of a first embodiment corresponding to FIG. 18, these supporting devices are integrated into the deflecting roller 13N.

Figure 18:
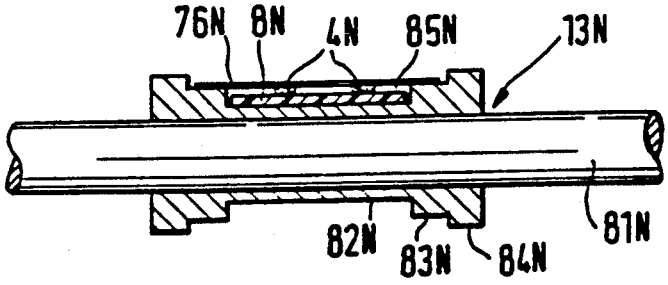
FIG. 18 is a partial sectional view along Line Y—Y of FIG. 17.

As indicated in FIG. 18, the deflection roller 13N, which is constructed as a loose roller arranged on a shaft 81N, is provided with a diameter that is graduated into three steps 82N, 83N, 84N. The transport belt 8N is guided on the inner step 82N with the smallest diameter. The guiding belt 76N slides on the center step 83N so that a distance 85N is maintained to the transport belt 8N. The outer step 84N is used as a lateral guide for the guiding belt 76N. The sliding friction occurring between the guiding belt 76N and the deflecting roller 13N may be accepted because the deflecting roller 13N runs very slowly; that is, at a circumferential speed of approximately 0.06 m to approximately 0.16 m per minute.

Figure 20:
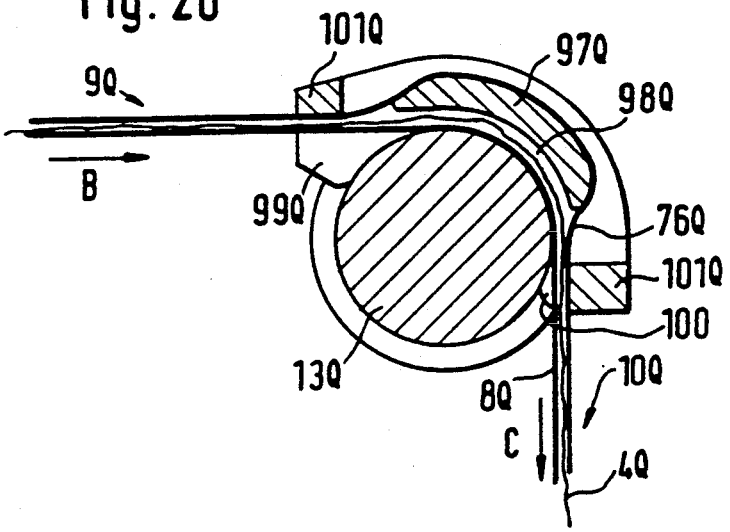

In the embodiment according to FIG. 20, a supporting element 97Q is provided which is supported on the deflecting roller 13Q by means of lateral sliding cheeks 99Q. The supporting element 97Q forms a tunnel 98Q through which the transport belt 8Q and the sliver 4Q travel. The guiding belt 76Q is guided on the exterior side of the tunnel 98Q. In addition, the supporting element 97Q is supported by means of two transverse webs 101Q on the exterior side of the guiding belt 76Q so that it retains its given position.

Figure 19:
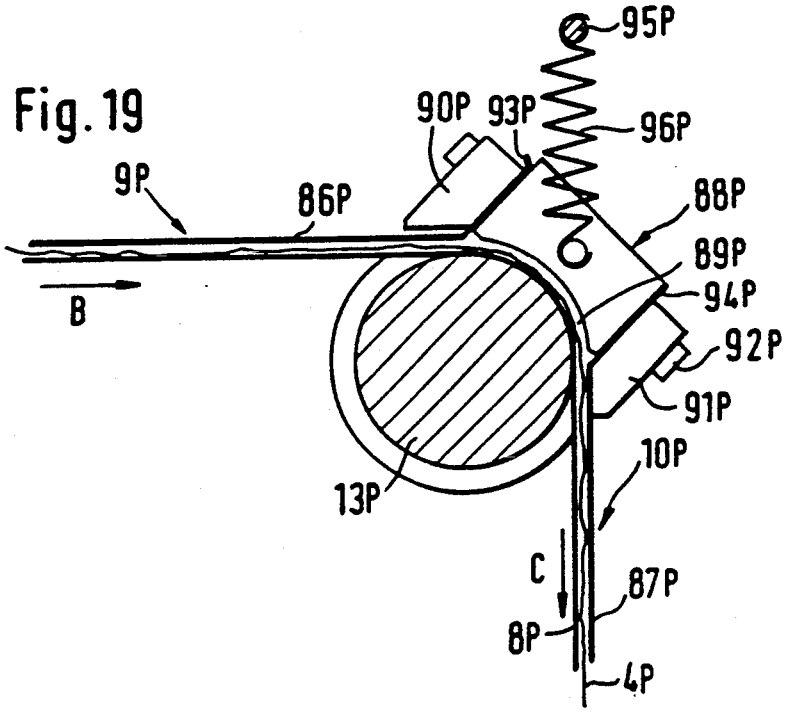
FIGS. 19 and 20 are views of details for supporting devices which hold the stationary guiding belts in the area of a deflection at a distance from the transport belt, according to a further preferred embodiment of the invention.

In the embodiment according to FIG. 19, it is provided that the guiding belt is divided into two parts 86P, 87P corresponding to the runs 9P and 10P. Parts 86P, 87P are connected with one another in the area of the deflecting roller 13P by means of a connecting element 88P. The ends 93P, 94P of these two parts 86P, 87P of the guiding belt are fastened to the holder 88P by means of pressure pieces 90P, 91P. The holder 88P, in the manner of a bridge, reaches over the pertaining transport belt 8P and the slivers 4P. In order to ensure that also the holder 88P is not supported with excessive forces against the contact pressure roller 13P, a relieving spring 96P is mounted on the holder 88P, the other end of which is fastened to a part 95P of the machine frame. This spring, which expediently as a deviation from the representation of FIG. 19, is arranged at an angle of 45° with respect to the horizontal line, is designed such that the holder 88P is supported on the deflecting rollers with only a force of approximately 7N.

In all shown embodiments, the slivers 4, 4' are withdrawn upward out of the cans 5, 5' in the direction of the arrows (A, A') and are then at least approximately horizontally along runs 9, 9' transported in the direction of the arrow (B) toward the machine center, after which, after a deflection in the direction of the arrow (C, C'), they are transported essentially vertically downward to the drafting units 3, 3'. They leave these drafting units 3, 3'in the direction of the arrow (D) in the downward direction and travel to a twist providing device, particularly a ring spindle. When, on the other hand, the cans 5, 5' are deposited on the floor 7, the slivers 4, 4' are also first withdrawn upward in the direction of the arrow (A, A'). However, then they extend along the runs 9 diagonally upward in the direction of the spinning machine and from there diagonally downward to the individual spinning stations.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A spinning machine comprising:

a plurality of spinning stations for the spinning of slivers fed in cans, drivable transport belts for conveying the slivers from the cans to the spinning stations, and stationary guiding belts which extend in parallel to the transport belts and form a sliding guide for the slivers to be transported by the transport belts, the slivers being guided between the transport belts and the guiding belts such that the slivers contact the transport belts and the guiding belts.

2. A spinning machine according to claim 1, comprising tensile stress applying devices for holding the guiding belts under tensile stress, and wherein end area supporting devices are provided for aligning end areas of the guiding belts.

3. A spinning machine according to claim 1, wherein tension devices which contain at least one spring element are provided for the guiding belts.

4. A spinning machine according to claim 1, wherein tension devices are provided for the guiding belts which contain a loading weight.

5. A spinning machine according to claim 1, wherein guiding belt deflecting devices are provided for deflecting the guiding belts in the direction of the transport belts.

6. A spinning machine according to claim 5, wherein the guiding belt deflecting devices are equipped with adjusting devices for adjusting the extent of the deflection.

7. A spinning machine according to claim 5, wherein the guiding belt deflecting devices are arranged between two deflecting rollers of the transport belts which bound an approximately vertical run.

8. A spinning machine according to claim 6, wherein the guiding belt deflecting devices are equipped with adjusting devices for adjusting the extent of the deflection.

9. A spinning machine according to claim 5, wherein the guiding belt deflecting devices have supporting surfaces for the guiding belts which are convexly curved by means of a relatively large radius of curvature.

10. A spinning machine according to claim 5, wherein the guiding belt deflecting devices have supporting surfaces for the guiding belts which are convexly curved by means of a relatively large radius of curvature.

11. A spinning machine according to claim 1, wherein transport belt deflecting devices are provided for deflecting the transport belts toward the guiding belts.

12. A spinning machine according to claim 11, wherein the transport belt deflecting devices are equipped with adjusting devices for adjusting the extent of the deflection.

13. A spinning machine according to claim 6, wherein the transport belt deflecting devices are arranged between two deflecting rollers of the transport belts which bound an approximately vertical run.

14. A spinning machine according to claim 10, wherein the transport belt deflecting devices are equipped with adjusting devices for adjusting the extent of the deflection.

15. A spinning machine according to claim 1, wherein the transport belt deflecting devices have supporting surfaces for the guiding belts which are convexly curved by means of a relatively large radius of curvature.

16. A spinning machine according to claim 6, wherein the transport belt deflecting devices have supporting surfaces for the guiding belts which are convexly curved by means of a relatively large radius of curvature.

17. A spinning machine according to claim 1, comprising spinning stations arranged on both sides of the machine, wherein common guiding belts are provided which are arranged in the area of the longitudinal center plane of the machine and are assigned to downward extending approximately vertical runs of the transport belts of mutually opposite spinning stations.

18. A spinning machine according to claim 17, wherein guiding belt deflecting devices are provided for deflecting the guiding belts in the direction of the transport belts.

19. A spinning machine according to claim 18, comprising spinning stations arranged on both sides of the machine, wherein common guiding belt deflecting devices are provided which are arranged in the area of the longitudinal center plane of the machine and are assigned to downward extending approximately vertical runs of the transport belts of mutually opposite spinning stations.

20. A spinning machine according to claim 17, wherein common tensioning devices for the guiding belts are arranged in the longitudinal center plane of the machine.

21. A spinning machine according to claim 17, wherein transport belt deflecting devices are provided for deflecting the transport belts toward the guiding belts.

22. A spinning machine according to claim 21, comprising spinning stations arranged on both sides of the machine, wherein common transport belt deflecting devices are provided which are arranged in the area of the longitudinal center plane of the machine and are assigned to downward extending approximately vertical runs of the transport belts of mutually opposite spinning stations.

23. A spinning machine according to claim 1, wherein the guiding belts are guided in parallel to an essentially horizontal run of the transport belts and an approximately vertical run thereof.

24. A spinning machine according to claim 23, wherein the guiding belts are held at a distance from the pertaining transport belt in an area of transition from the essentially horizontal run to the approximately vertical run by means of supporting devices.

* * * * *